US005097970A

United States Patent [19]

Lamoureux

[11] Patent Number: 5,097,970

[45] Date of Patent: Mar. 24, 1992

[54] APRON SYSTEM FOR A GRANULATOR

[75] Inventor: Richard R. Lamoureux, Millville, Mass.

[73] Assignee: Nelmor Company, Inc., North Uxbridge, Mass.

[21] Appl. No.: 532,452

[22] Filed: Jun. 4, 1990

[51] Int. Cl.[5] ..... B02C 23/02

[52] U.S. Cl. ..... 211/180

[58] Field of Search ..... 211/180; 56/500, 501, 56/502, 503, 504, 505; 144/3 D, 337; 241/285 R

[56] References Cited

U.S. PATENT DOCUMENTS 3,643,880 2/1972 Peterson ..... 241/385 R X 3,895,761 7/1975 Mills ..... 241/285 R X

*Primary Examiner*—Robert W. Gibson, Jr.

*Attorney, Agent, or Firm*—Samuels, Gauthier & Stevens

[57] ABSTRACT

An apron rack assembly for a granulator. The assembly includes upper crossmembers over which aprons are draped. The assembly is inserted into the hopper as an integral unit. The aprons are secured in place between the crossmembers and the roof of the hopper.

6 Claims, 4 Drawing Sheets

APRON SYSTEM FOR A GRANULATOR

BACKGROUND AND BRIEF SUMMARY OF THE INVENTION

The infeed throat of a granulator hopper requires some type of barrier or door that will both permit entry of material and minimize the escape of noise and granulated product (flyback). This has been accomplished in the past through the use of metal pivoting doors as well as curtains made from a rubber compound. The latter are referred to as "aprons" and are commonly used on most granulators. A typical granulator requires a series of aprons, one behind the other, to effectively control the noise and flyback. These aprons have usually been fastened to the ceiling of the hopper, using several rivets or bolts. Regardless of whether rivets or bolts are used, the ability to remove the aprons for cleaning or for replacement is a long, tedious process.

Most manufacturers of granulators have used bolts because they are easier to remove than rivets. However, the presence of any fastener inside the granulator risks the possibility of a metal object accidentally falling into the knife area of the machine, causing damage to the knives. Also, it is inconvenient and time-consuming to reach deep into the throat of a hopper to remove and replace fasteners that retain the rear aprons.

A rod and tube method of attaching aprons has been used so that individual aprons may be removed for easy access. However, this is fairly expensive and still requires the removal and replacement of a multitude of fasteners.

The present invention comprises an apron rack assembly for a granulator that does not require any fasteners inside the infeed opening of the hopper. Broadly, the assembly consists of a rack which supports the aprons. The aprons have a long notch cut into each edge, so that once they are mounted onto the rack they are retained. Each apron drapes over a portion of the rack, such that is produces a double barrier and therefore replaces two conventional aprons. Usually, four or more barriers are required to be effective. The entire rack/apron assembly is then installed into the hopper opening. The rear of the rack rests on two small ledges inside the hopper and is secured in front by two bolts which are inserted along a horizontal axis through the upper lip of the hopper opening. As these bolts are installed, a portion of each apron is compressed or clamped between the top of the rack and the roof of the hopper, thus creating an added retention feature for the aprons. Both bolts are installed or removed from the outside of the hopper, making it unnecessary to have any fasteners inside the granulator.

To remove the rack with aprons for cleaning, the two bolts are simply removed, the front of the rack is lowered slightly, and the entire assembly is pulled out of the hopper. To remove and replace the aprons, the old ones are slipped or cut off and the new ones are slipped in. Once the rack is re-inserted into the hopper and the two bolts are installed, the job is complete. What used to take up to an hour can now be done in 5-10 minutes. Fewer individual aprons are required and each one is larger (one new apron replaces two of the old style).

DESCRIPTION OF THE PREFERRED EMBODIMENT

Figure 1:
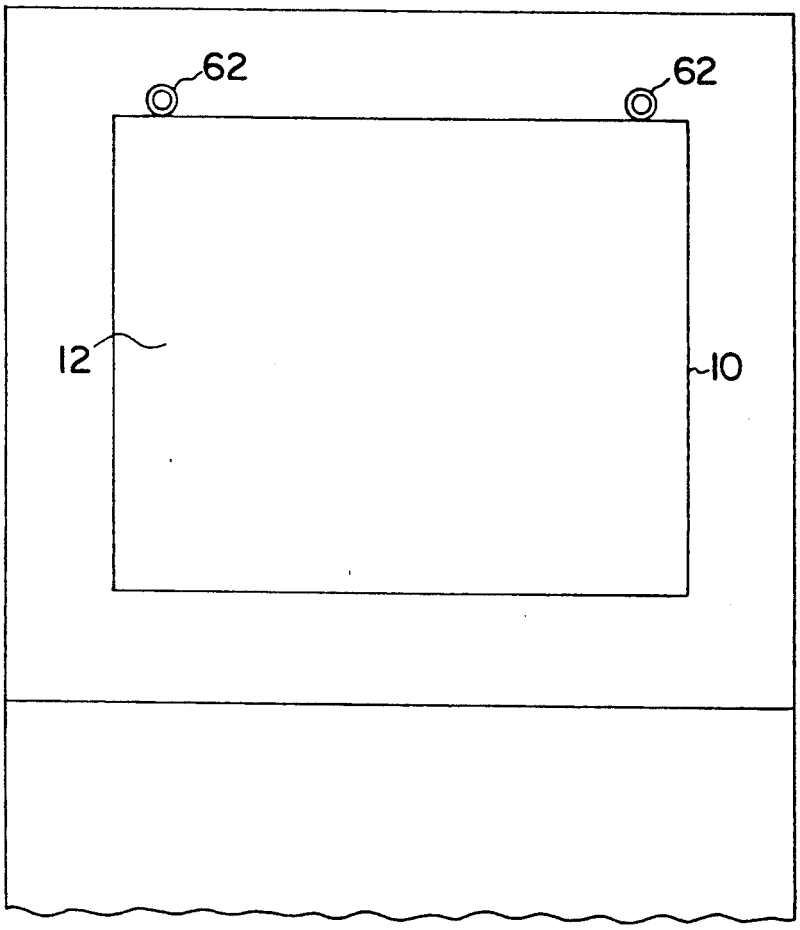
FIG. 1 is a front view of a granulator illustrating the infeed throat of a granulator hopper.
Figure 2A:
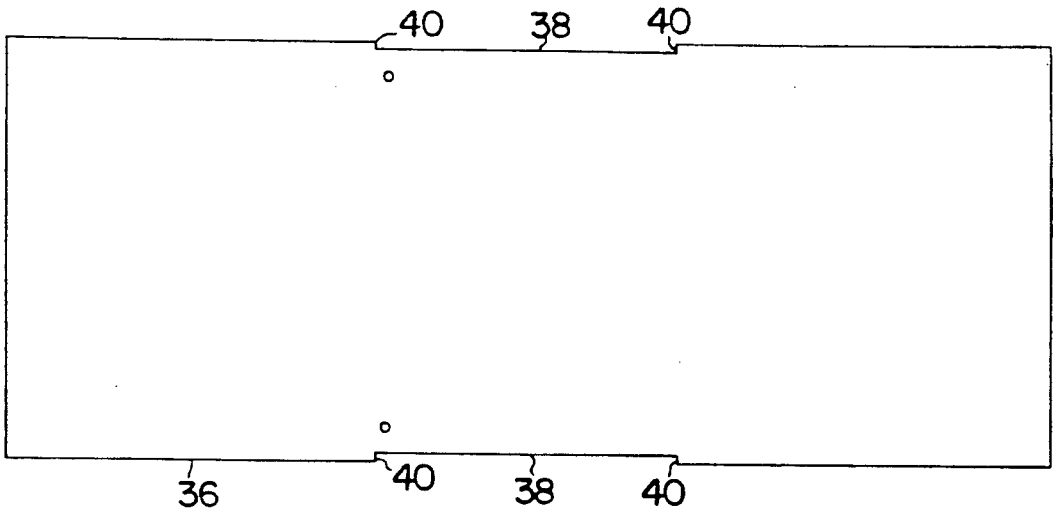
FIGS. 2a, 2b and 2c are plan views of the component parts of the rack/apron assembly.
Figure 2B:
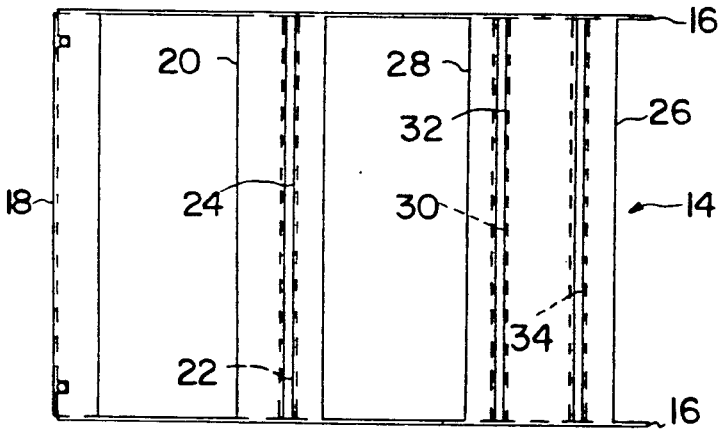
Figure 2C:
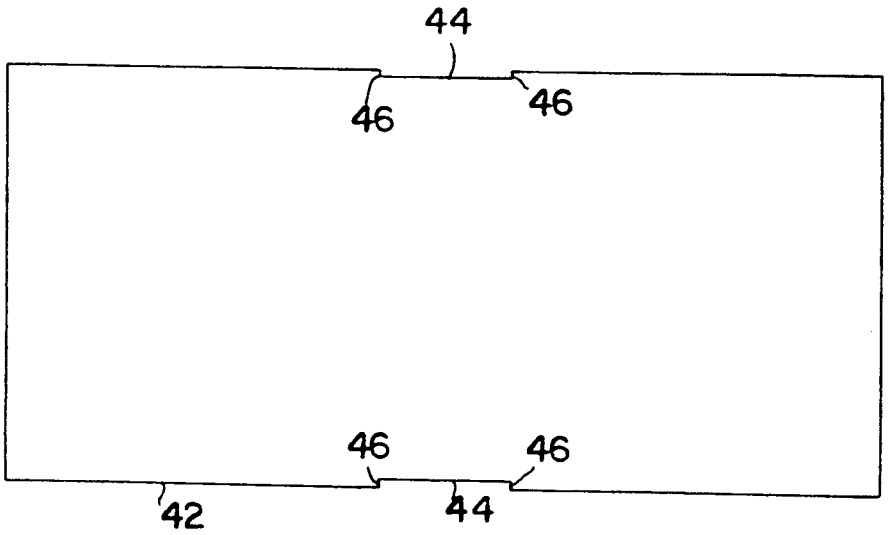

Referring to FIG. 1, an infeed throat of a hopper is shown at 10. The rack/apron assembly 12 embodying the invention is received in this infeed throat.

Referring to FIGS. *2a*, *2b* and *2c*, the components of the assembly 12 are shown and comprise a rack 14 having depending parallel sides 16. Cross-members and particularly angle irons 18, 20 and 22 in parallel spaced-apart relationship define a first apron support. The irons 20 and 22 are paired to define a slot 24.

Angle irons 26 and 28 and a U-shaped beam 30 in parallel spaced-apart relationship define slots 32 and 34 and together define a second apron support.

A first apron 36 is shown in extended form and comprises notches 38 formed in its side edges intermediate the ends of the apron 36. The notches 38 define steps 40 in the side edges.

A second apron 42 includes notches 44 formed in its side edges and intermediate the ends of the apron 42. The notches 44 define steps 46 in the side edges.

Figure 3:
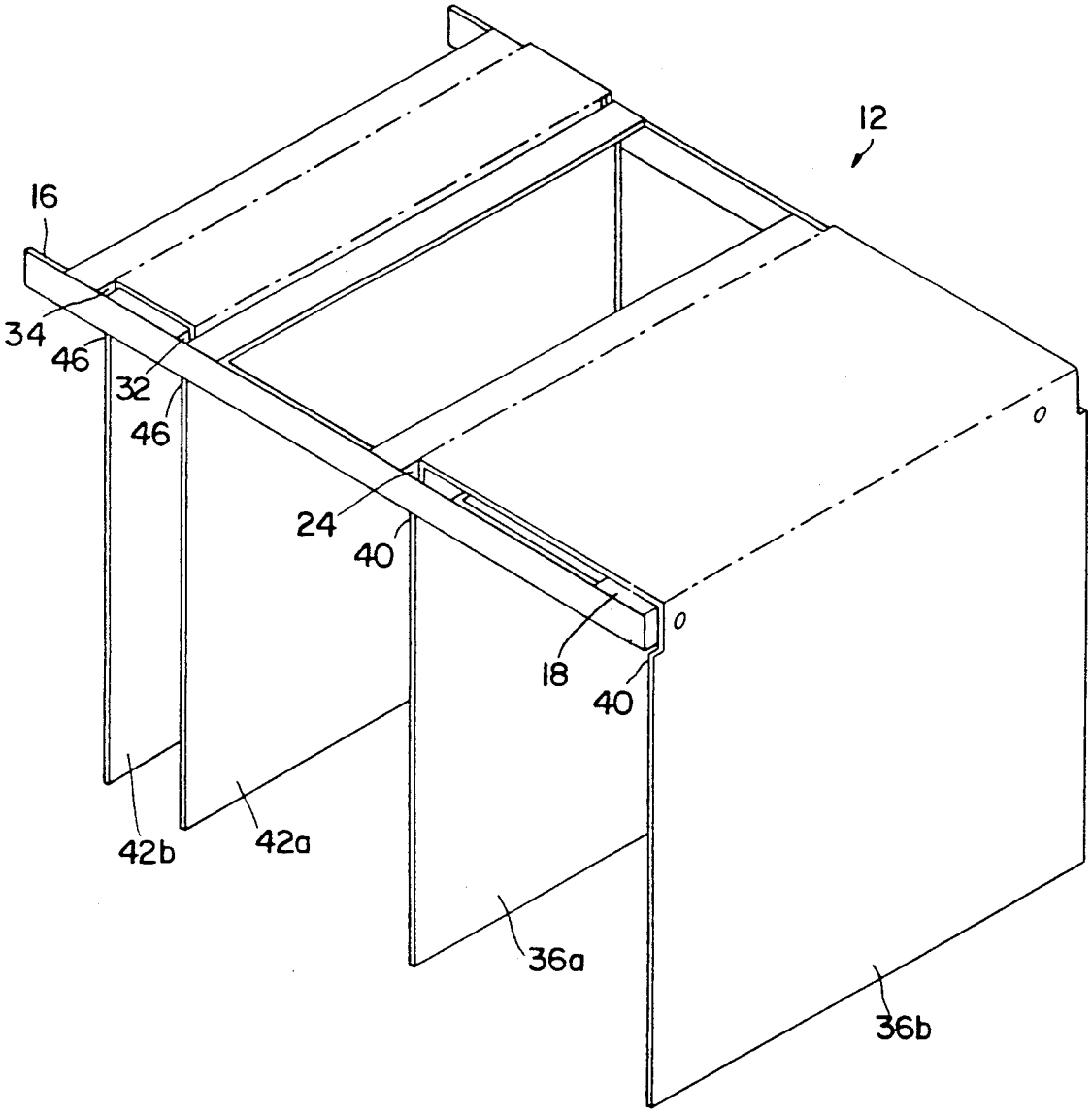
FIG. 3 is a perspective view of a rack/apron assembly embodying the invention.

Referring to FIG. 3, the first apron 36 extends over the angle iron 18 and through the slot 24 to form two aprons 36*a* and 36*b*. The steps 40 extend under and engage the lower edges of the sides 16.

The apron 42 passes through the slots 32 and 34 to form two aprons 42*a* and 42*b*. The steps 46 extend under and engage the lower edges of the sides of 16.

Figure 4:
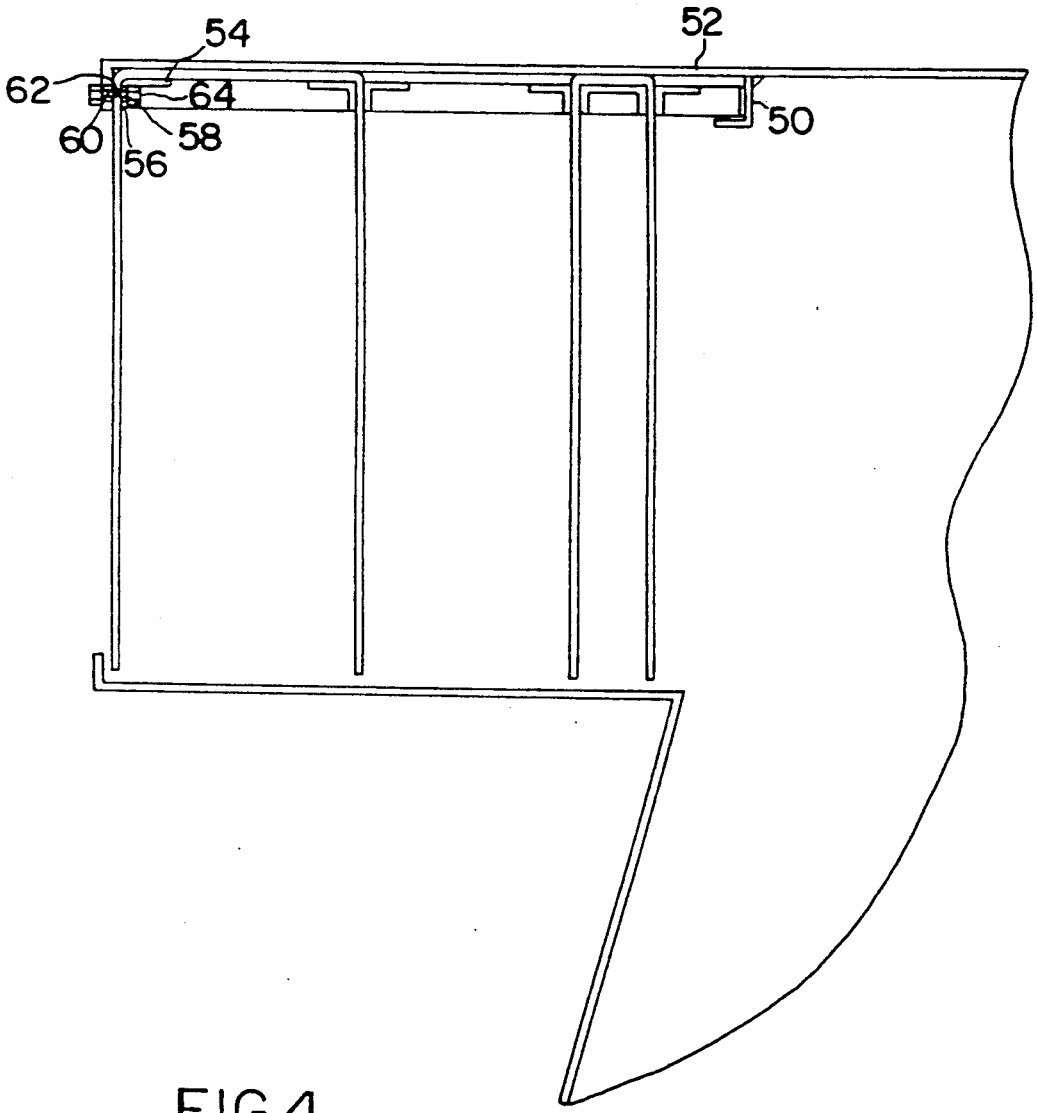
FIG. 4 is a side view of the assembly of FIG. 2 in an infeed throat.

Referring to FIG. 4, two angle irons 50 are secured to the hopper roof 52. Each angle iron 50 functions as a support ledge for one side 16 of the rack. The iron 18 has a horizontal leg 54 and a vertical leg 56. The leg 56 includes two holes 58 (only one shown). In concentric alignment with each hole 58 is a threaded nut 64. Each nut is attached to the vertical leg 56. The front of the hopper includes two holes 60 (only one shown) through which fasteners 62 pass (see FIG. 1). When these fasteners 62 are threaded onto the nuts 64, they secure the rack to the hopper. The holes 58 and 60 are aligned such that when the assembly 12 is secured in place by the fasteners 62, the top surfaces of the aprons 36 and 42 are clamped between the hopper roof and the angle irons 18 and 20 and the beam 30 respectively.

The rack is manufactured by forming and welding steel components. Aprons are die-cut from sheets of a special rubber compound which is designed to produce a noise barrier. Racks are formed and welded from steel as in the past.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. An apron rack assembly for an infeed throat of a hopper which comprises:

a rack having sides and cross-members, the cross-members defining at least one apron support;

an apron passing over the upper surface of the support and depending therefrom: and means to secure the rack in the throat and to secure compressively the apron between the rack and the hopper.

2. The assembly of claim 1 wherein the cross-members define a slot therebetween, the apron passes through the slot and drapes downwardly thereby forming two aprons.

3. The assembly of claim 1 wherein the sides comprise first ends adjacent the hopper entrance and second ends within the hopper and which includes:

means to secure the second ends within the throat.

4. The assembly of claim 1 wherein one cross-member is adjacent the hopper entrance and which includes: means to secure said member to the hopper.

5. The assembly of claim 1 which includes:

at least two sets of cross-members and aprons, the aprons depending from the cross-members.

6. The assembly of claim 1 wherein the apron includes notches along its sides intermediate its ends, the notches defining steps in said sides, the notches engaging the lower edges of the sides when the rack is secured in the throat.

* * * * *